United States Patent [19]

MacKew

[11] 4,455,008

[45] Jun. 19, 1984

[54] MODULAR SUPPORT SYSTEM

[76] Inventor: James MacKew, 1221 Westbury Dr., Mobile, Ala. 36609

[21] Appl. No.: 218,370

[22] Filed: Dec. 22, 1980

[51] Int. Cl.[3] ..... A47B 19/00

[52] U.S. Cl. ..... 248/447.2; 248/455; 248/447.1; 5/507

[58] Field of Search ..... 248/441.1, 447.2, 447.4, 248/448, 455, 458; 5/507

[56] References Cited

U.S. PATENT DOCUMENTS

| | | | |
|---|---|---|---|
| 1,281,682 | 10/1918 | Southworth | 248/447.4 |
| 1,531,540 | 3/1925 | Calero | 248/441.1 |
| 1,598,569 | 8/1926 | Fitzhugh | 248/442.4 |
| 1,682,180 | 8/1928 | Merrill | 248/447.4 |
| 1,821,060 | 9/1931 | Isaacson | 248/455 |
| 3,606,235 | 9/1971 | Young | 248/458 |
| 3,926,398 | 12/1975 | Vincent | 248/458 |
| 4,165,856 | 8/1979 | Wiseheart | 248/455 |

FOREIGN PATENT DOCUMENTS

| | | | |
|---|---|---|---|
| 553555 | 6/1932 | Fed. Rep. of Germany | 248/458 |
| 2230461 | 1/1974 | Fed. Rep. of Germany | 248/448 |
| 1122256 | 1/1956 | France | 248/447.4 |
| 442111 | 2/1936 | United Kingdom | 248/455 |
| 925894 | 5/1963 | United Kingdom | 248/449 |

*Primary Examiner*—Alexander Grosz
*Assistant Examiner*—Michael F. Trettel
*Attorney, Agent, or Firm*—Albert L. Jeffers

[57] ABSTRACT

A modular arrangement for supporting any one of a wide variety of sizes of reading and other materials at a freely selectable location in relation to any selected one of a wide variety of local environments, such as chairs, sofas, tables and the like is disclosed and includes an expansible reading material holding assembly along with a plurality of support mechanisms each accepted for attachment to a different class of local environment and an arrangement for coupling the holding assembly to a select one of the support mechanisms to provide limited manual adjustability of the elevation of the holding assembly relative to the selected support mechanism as well as a limited amount of manual adjustability of the holding assembly, from vertical to horizontal, as may be preferenced by the various users. In the horizontal attitude the holding assembly functions as a table. The coupling means may include an articulated arm comprising a pair of arm members journaled together at respective first ends for unrestricted angular movement in a generally horizontal plane with one of the arms having its second end pivotably attached to the support mechanism and the other of the arms having its second end pivotably supporting the material holding assembly. The material holding assembly may include lateral extension portions and telescopic risers movable in generally orthogonal directions to expand and contract the reading material support area.

22 Claims, 18 Drawing Figures

MODULAR SUPPORT SYSTEM

BACKGROUND OF THE INVENTION

The present invention relates generally to bookrests and similar reading material support mechanisms and more particularly to such a mechanism which is adaptable to a wide variety of sizes of reading material as well as a wide variety of environmental attachments.

Reading material supports are of course well known and include lecterns, music stands and similar arrangements. Several specific purpose devices for supporting a book relative to a chair have also been devised but have always suffered the drawback of limited versatility, that is, they may be attached to only a very restricted class of chairs. These known bookrests also suffer from the defect of having a very limited range of adjustability within their particular environment. Such special purpose bookrests have therefore met with little commercial success.

SUMMARY OF THE INVENTION

Among the several objects of the present invention may be noted the provision of a reading material support arrangement which is extremely versatile with respect to the devices to which it may be attached, positioning relative to that attachment, and the size of the reading material which it may support; the provision of a modular reading support assembly adaptable to a wide variety of local environments by the simple expedient of changing one of its subassemblies; the provision of a reading material support assembly which may be expanded to support something as large as a newspaper or contracted to a suitable size for supporting a conventional book; the provision of a modular reading material support arrangement which may be affixed to a wide variety of local environments including wheelchairs, tables, desks, overstuffed chairs or couches, or supported on a bed; and the provision of a modular reading material support arrangement characterized by its versatility with respect to the material supported as well as the environment supporting the device. These as well as numerous other objects and advantageous features will be in part apparent and in part pointed out hereinafter.

In general, the reading material support apparatus includes an expansible reading material holding assembly, a plurality of support mechanisms each adapted for attachment to a different class of local environment and an arrangement for coupling the holding assembly to a selected one of the support mechanisms to provide a limited amount of manual adjustability of the holding assembly elevation relative to the selected support mechanism as well as a limited amount of manual adjustability of te angular relationship of the holding assembly relative to a vertical direction.

Also in general, and in one form of the invention, a reading material supporting apparatus includes an expansible reading material holding assembly, a plurality of support mechanisms each of which is adapted to be attached to a different type or piece of furniture, along with a coupling arrangement for holding the assembly to a selected support mechanism inluding an articulated arm having a pair of arm members journaled together at respective first ends as well as having their respective second ends journaled one to the selected support mechanism and the other to the material holding assembly with these three journalings providing unrestricted angular movement in a generally horizontal plane so that the reading material may be located anywhere in a horizontal circle of radius generally the sum of the effective lengths of the two arm members.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
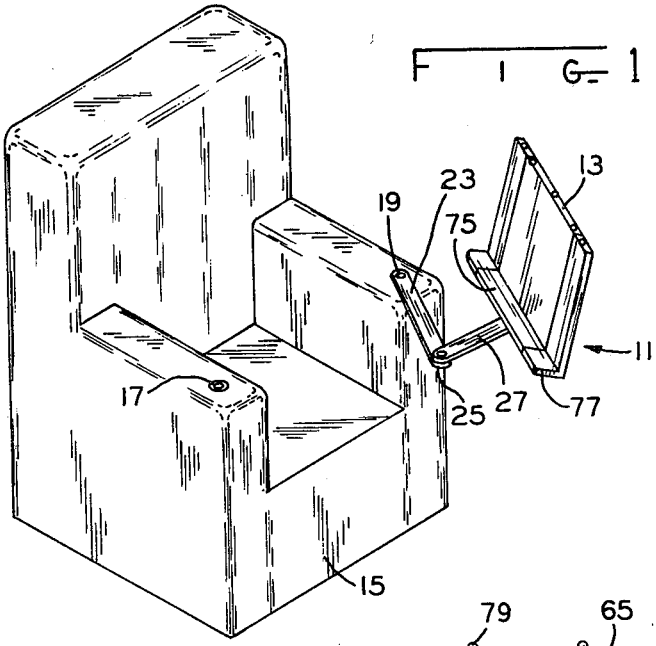
FIG. 1 is a perspective view of a reading material support apparatus in the local environment of an overstuffed chair adapted to accept the apparatus.
Figure 3:
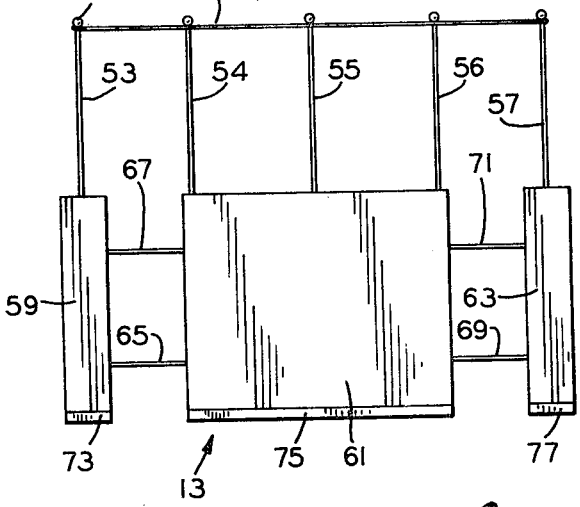
FIG. 3 is a view of the reading material holding assembly as in FIG. 2 but illustrating that assembly in its expanded state.
Figure 2:
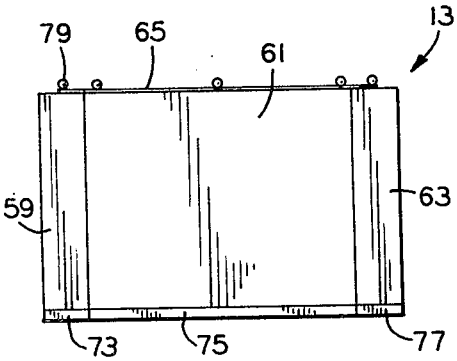
FIG. 2 is a view of the front of the expansible reading material holding assembly.
Figure 4:
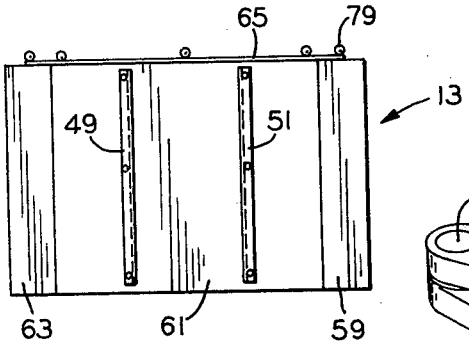
FIG. 4 is a view of the reading material holding assembly of FIG. 2 from the backside thereof.
Figure 5:
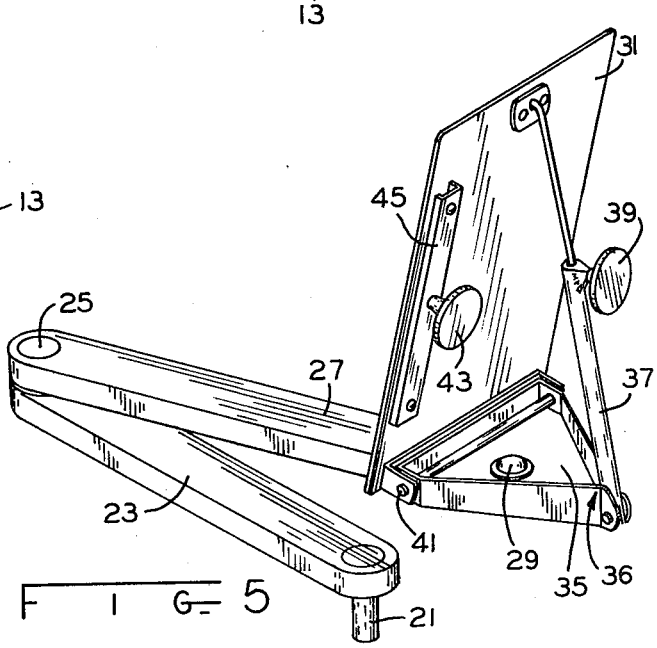
FIG. 5 illustrates an arrangement for coupling the holding assembly to a selected support mechanism particulary suited to the arrangements of FIGS. 1 through 4, 9, 10, 11, 15 and 16.
Figure 7:
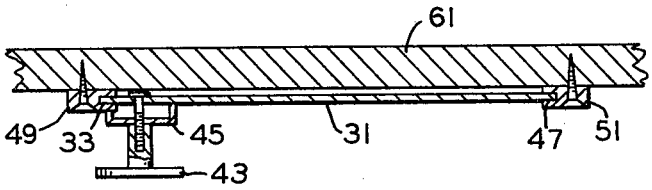
FIG. 7 is an edge view of the reading material holding assembly illustrating the manner in which that assembly is attached to the coupling arrangement.
Figure 8:
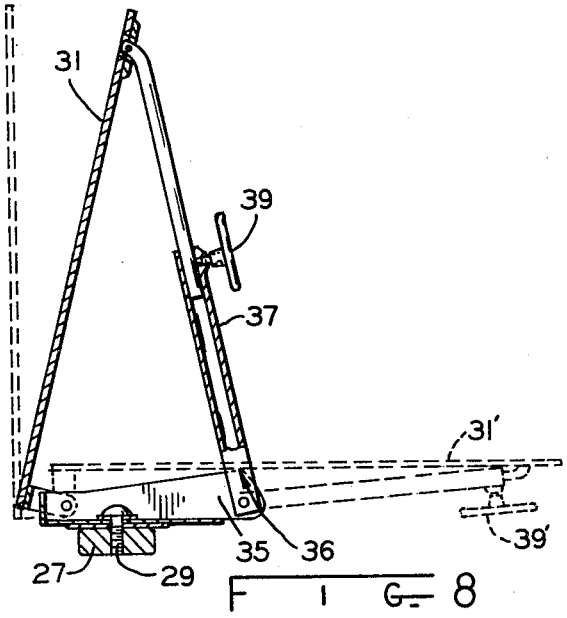
FIG. 8 is a side view illustrating the coupling arrangement and the manner in which it is adjusted relative to a vertical direction.
Figure 9:
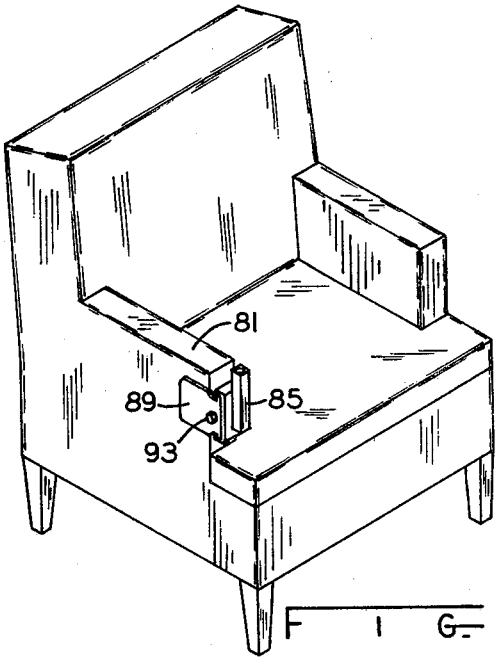
FIG. 9 illustrates the adaptation of an overstuffed chair local environment to support the reading material rest including a C-clamp like coupling arrangement.
Figure 10:
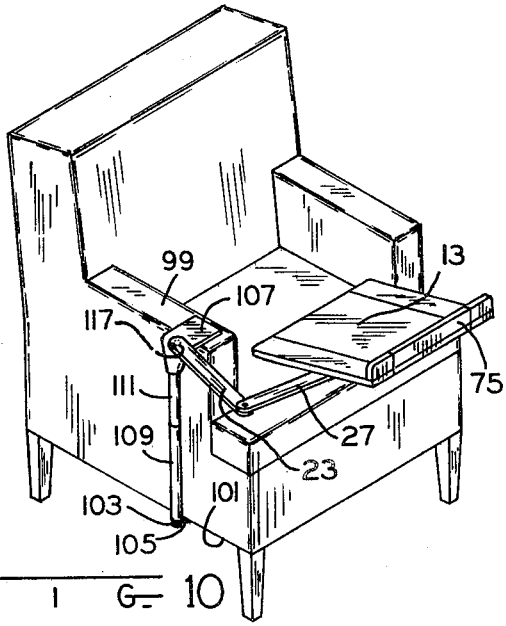
FIG. 10 illustrates the adaptation of an overstuffed chair to support the apparatus including a substantially different C-shaped clamp as part of the coupling arrangement and illustrating the apparatus in a table top attitude.
Figure 12:
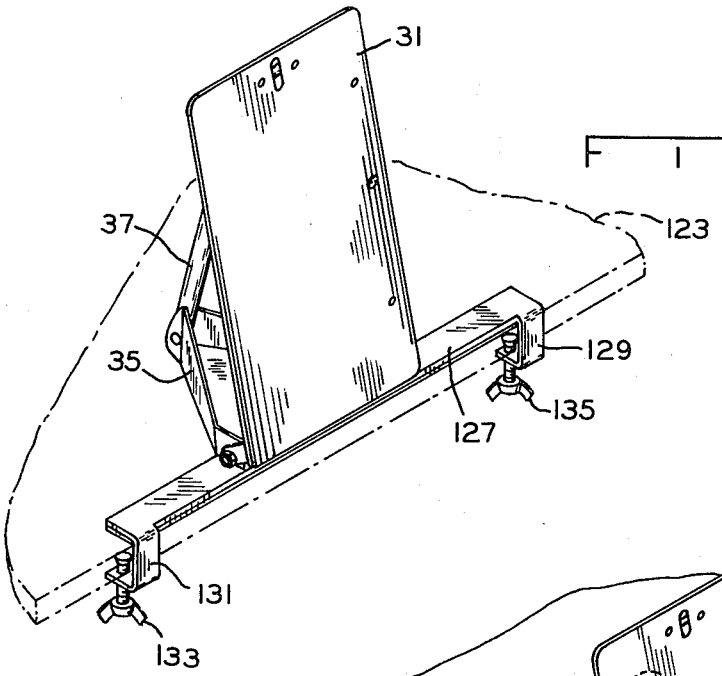
FIG. 12 illustrates a somewhat different coupling arrangement for supporting reading material on a desk or table.
Figure 13:
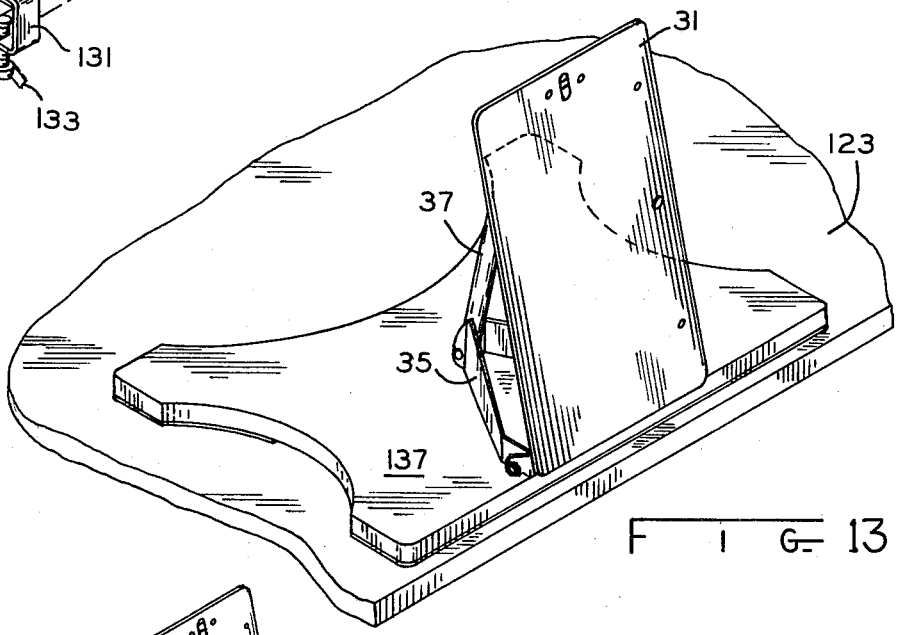
FIG. 13 illustrates yet another arrangement for supporting reading material on a flat surface.
Figure 14:
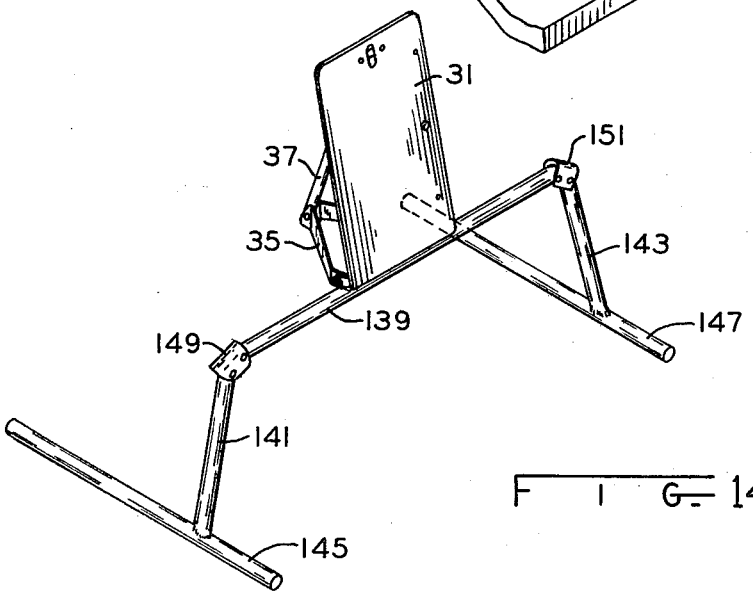
FIG. 14 illustrates an arrangement for supporting reading material on a bed.
Figure 16:
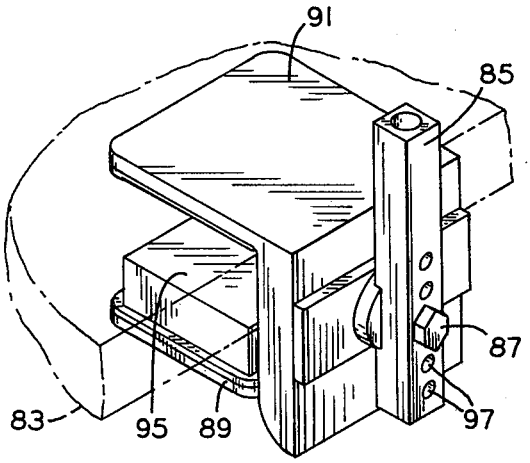
FIG. 16 illustrates the clamping arrangement of FIG. 9 in another environment.
Figure 17:
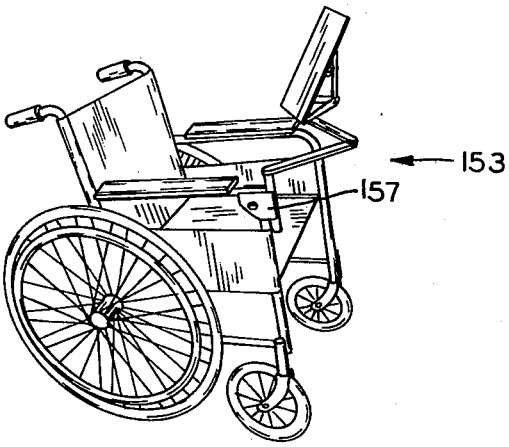
FIG. 17 illustrates the reading material support on a wheelchair.
Figure 18:
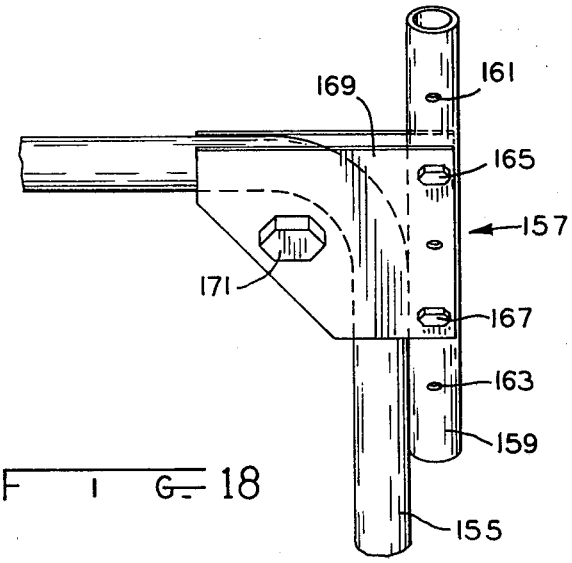
FIG. 18 shows the clamp of FIG. 17 in detail.

Referring now first to the drawings generally, the reading material support apparatus 11 of FIG. 1 is seen to include an expansible reading material holding assembly 13 of FIGS. 2, 3 and 4 along with a plurality of support mechanisms as illustrated in FIGS. 1 and 9 through 16, each of which is adapted for attachment to a different class of local environment such as an overstuffed chair or sofa illustrated in FIGS. 1, 9 and 10, or a desk or table top as illustrated in FIGS. 11, 12, 13 and 16, a wheelchair as in FIG. 17 and 18, or even supported on a bed as in FIG. 14. The holding assembly is coupled to a selected one of the support mechanisms by arrangements such as illustrated in FIGS. 5, 7, 12, 13, 14 and 17, so that a limited amount of manual adjustability of the elevation of the holding assembly relative to the selected support mechanism may be achieved primarily as illustrated in FIGS. 5 and 7, as well as a limited amount of manual adjustability of the angular relationship of the holding assembly as illustrated by shaped lines in FIG. 8. When in the horizontal position, the holding assembly also serves as an auxiliary table for writing, serving food, etc.

Referring more particularly to FIG. 1, the overstuffed chair 15 is provided with a like pair of sleeve bearings 17 or 19 into which a stud 21 of FIG. 5 may be placed so that the arm member 23 freely pivots in a horizontal direction. Arm member 23 is pivotably attached as at 25 to another arm member 27 to provide an articulated arm arrangement for supporting the reading material holding assembly. This holding assembly 13 is pivotably attached to arm member 27 as at pivot point 29 of FIG. 5.

Figure 6:
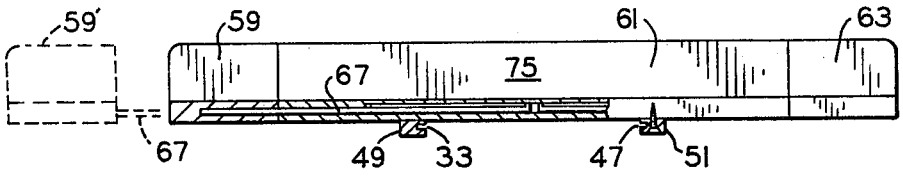
FIG. 6 is an edge view of the reading material holding assembly illustrating its expansibility.

In FIG. 5, the remaining coupling arrangement will be seen to include a generally planar member 31 for slidingly accepting the material holding assembly as in grooved rails, such as 33 of FIG. 6, and in the manner illustrated in FIG. 7. The coupling arrangement also includes a pivotable base member 35 and a variable length telescopic support leg 37, the length of which may be set by loosening locking knob 39 and telescopically sliding the two portions of the support leg 37 to increase or decrease its length, thereby also changing the angular relationship of the planar member 31 a limited amount relative to a vertical and horizontal direction since that planar member hinges relative to the base 35 on a horizontal axis pin 41. Location 36 of base 35 serves as a limiting stop for the planar member 31 when the material holding assembly is laid flat for use as an auxiliary table.

FIG. 5 illustrates a further locking knob 43 and a locking plate 45 for adjustably fixing the elevation of the reading material holding assembly 13 as it slides along the planar member 31.

Comprising FIGS. 5, 6 and 7, it will be seen that the planar member 31 may have its horizontal edges engaged in the slots 33 formed by grooved rails 49 and 51 on the backside of the reading material holding assembly. Thus, the locking knob 43 is loosened somewhat and the reading material holding assembly slid downwardly to grasp the planar member 31 until a preferred elevation is reached at which time locking knob 43 is tightened so that the locking member or plate 45 grips both the planar member 31 and the strip 49 on the backside of the reading material holding assembly to securely fasten those two parts together.

Referring now to FIGS. 2, 3 and 4, it will be noted that the material holding assembly 13 includes a set of telescopic risers 53, 54, 55, 56 and 57 which are telescopically received in the three panel portions of the material holding assembly 59, 61 and 63, respectively. These risers may be depressed so as to be nearly flush with the top surface of the material holding assembly or pulled outwardly to the extended position illustrated in FIG. 3 for supporting larger reading materials such as a newspaper. An elastic band 65 may be placed about the upper ends of the risers for additional support, if desired. The panel portions 59 and 61 are also telescopically coupled together by rods 65 and 67 so that the two outer portions may be pushed together or slid apart as desired to expand or contract the reading material support surface in a direction generally orthogonal to the direction of expansion of the risers 53, 54, 55, 56 and 57. Similarly, the panel support surfaces 61 and 63 may be expanded or contracted relative to one another along the further rods 69 and 71. Each of the panel support surfaces 59, 61 and 63 includes an outwardly extending ledge portion 73, 75 and 77, respectively, to prevent the reading material from sliding into the reader's lap. To prevent the outward movement or slippage of loose reading materials, the resting surfaces of ledges 73, 75 and 77 have incorporated into them a multiple grooved non-slip material. Small knobs or steel balls, such as 79 prevent the risers, such as 53 from sliding completely downward into the panel portion and also provide a convenient structure to grip for extending those risers. This expansible feature of the reading material holding assembly is also illustrated in the top view of FIG. 6 where dotted line structures and primed reference numerals indicate, as throughout the specification, an alternate positioning of the parts.

While in FIG. 1 the support mechanism in the form of sleeve bearings 17 was built into the overstuffed chair 15, FIG. 9 and 10 illustrate two alternate forms for support mechanisms which may be attached to an overstuffed chair or sofa with the support mechanism of FIG. 9 being adaptable to wheelchairs, thick tables and number of other local environments, as illustrated in FIG. 16.

Referring specifically to FIGS. 9 and 16, the support mechanism is seen to comprise a C-clamp type mechanism for spanning and gripping a chair arm 81 or a tabletop 83. The support mechanism includes a pivotable sleeve bearing 85 which may be pivoted to a vertical direction regardless of the orientation of the environmental element gripped by loosening bolt 87 and rotating the sleeve about the axis of that bolt to a desired vertical orientation. The C-clamp portion of the mechanism includes a movable plate 89 which is forced toward plate 91 by tightening bolt 93. A spacer 95 may be used in conjunction with this support mechanism if desired to extend the versatility of this particular support mechanism. A number of apertures 97 for accepting bolt 87 add further versatility to the arrangement.

Figure 15:
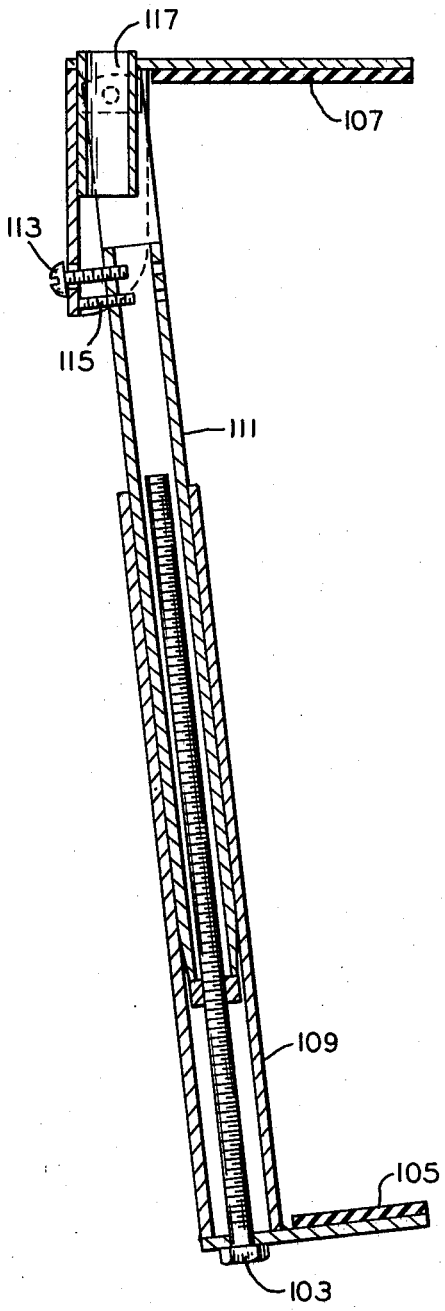
FIG. 15 illustrates the C-shaped clamp of FIG. 10 in detail.

Referring specifically to FIGS. 10 and 15, the support mechanism is seen to include a much larger elongated C-shaped clamp for spanning the distance between the upper surface 99 of an arm rest and a lower crossframe member 101 beneath that arm rest. The clamp height is varied by loosening or tightening bolt 103 so that the arm rest and frame member may be securely gripped between the foot 105 and the upper clamping leg 107. This C-shaped clamp comprises a pair of telescoping tubular members 109 and 111, each of which is provided with a clamping leg 105 and 107, respectively, with the upper clamping leg 107 providing a selectable amount of angular adjustment by loosening and then retightening bolts 113 and 115 to allow positioning of the upper clamping leg 107 in a nearly horizontal attitude despite the substantial deviation of the telescoping tubular members from vertical as may be necessary on some designs of sofas or overstuffed chairs. As before, the tubular sleeve bearing 117, of course, receives stud 21 when the assembly is in position for use.

Referring now to FIG. 17 and 18, a tubular metal arm 155 of a conventional wheelchair 153 is used to support the reading material supporting apparatus. Of course this arrangement is applicable to other environments such as chairs with tubular metal arm rests. In FIG. 17 the same basic structure as illustrated in FIG. 5 is attached to the wheelchair arm by support mechanism 157. In FIG. 18 this support mechanism is seen to include a sleeve bearing 159 in the form of a hollow, metal tube having a plurality of transverse holes such as 161 and 163 for selectively receiving bolts 165 and 167 so as to position the sleeve 159 at a preferred elevation relative to the two parallel plates 169. A bolt 171 also connects the two parallel plates 169 so that these plates may be positioned on opposite surfaces of the arm 155 and the bolt on 171 tightened to securely clamp the arm 155 between the plates 169. As before, the sleeve 159 receives the pin or stud 21 of the apparatus illustrated in FIG. 5 with the arrangement of FIGS. 17 and 18 providing a secure support mechanism for the reading material holding assembly.

Figure 11:
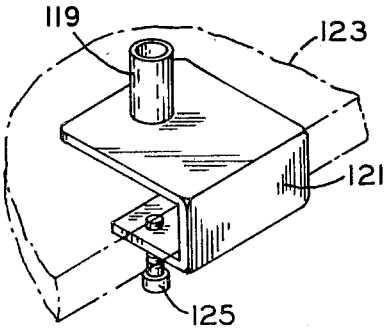
FIG. 11 illustrates yet another substantially different C-shaped coupling arrangement for adapting the reading material support system to a table or desk.

Referring now to FIG. 11, a sleeve bearing 119 for receiving stud 21 of FIG. 5 is an integral part of the C-shaped clamp member 121 and this clamping member is easily affixed to a table or desk top 123 by tightening the clamping bolt 125.

FIGS. 12 and 13 illustrate two further alternate ways in which the reading materials supporting apparatus may be positioned on desk or table top 123. In each, a base portion 35 like that illustrated in FIG. 5, may be provided, however, the pivotable attachment axis 29 may be deleted, if desired. The remaining structure illustrated in FIGS. 12 and 13 including the planar member 31 for slidingly receiving the reading material holding assembly of FIGS. 2, 3, 4, 6 and 7 remains as above discussed, including the adjustable tripod support leg 37.

FIG. 12 employs an elongated bar 127 including integral C-shaped clamps 129 and 131 at the opposite ends thereof and wing bolts 133 and 135 which may be tightened to clamp the bar 127 securely to the top 123. Base member 35 is preferably spot welded to the bar 127 in this form of the invention.

FIG. 13 differs from FIG. 12 in that a simple flat board 137 has base member 35 attached thereto as by screws so that the same essential structure as illustrated in FIG. 5 but without arms 23 and 27 and lacking the pivotability about axis 29 may be positioned on the surface 123 in any desired location.

In FIG. 14, the same basic structure as illustrated in FIG. 5, but again lacking arms 23 and 27, as well as the pivotability about axis 29 is illustrated supported on a cross member 139 as by spot welding attachment bolts. The cross member 139 is pivotably attached to a pair of downwardly depending upright members 141 and 143 with the other ends of those upright members attached as by welding to a pair of legs 145 and 147. Thus, these legs 145 and 147 may rest on a bed and an individual in that bed may easily read materials supported on the holding assembly which is not illustrated in this Figure but which affixes as before to the planar member 31. Storage of this structure is facilitated by hinges 149 and 151 each having a pair of generally horizontally disposed pivot pins for coupling the uprights 141 and 143 to the cross member 139 while limiting the outward movement of the legs. Thus, the legs are pivoted toward one another for limiting the outward movement of the legs. Thus, the legs are pivoted toward one another for storage.

As noted earlier, the means for coupling provides sufficient latitude in adjustability of the angular relationship of the holding assembly relative to a vertical direction that the holding assmebly may be positioned in a generally horizontal attitude for use as a table. Such a tabletop attitude of the flat surface of the material holding assembly is illutrated in FIG. 10. Here the system is functioning as a table system and may be used to support food trays, typewriters, jigsaw puzzles, and a wide variety of other items. Such a table system is particularly useful to invalids but also is of substantial value to others.

From the foregoing it is now apparent that a novel apparatus for supporting any one of a wide variety of sizes of reading materials at a freely selectable location in relation to any selected one of a wide variety of local environments and employing the same structures insofar as possible by making each support mechanism compatible with the coupling and holding assemblies but with each support mechanism differing significantly from the others in the manner in which it may be attached to the local environment has been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. Apparatus for supporting any one of a wide variety of sizes of reading materials at a freely selectable location in relation to any selected one of a wide variety of local seating environments comprising:

an expansible reading material holding assembly having lateral extension portions and telescopic risers movable in generally orthogonal directions relative to each other to expand and contract the reading material support area;

a plurality of support mechanisms each adapted for attachment to a different class of local seating environment; and means for coupling the holding assembly to a selected one of the support mechanisms and providing a limited amount of manual adjustability of elevation of the holding assembly relative to the selected support mechanism as well as a limited amount of manual adjustability of the angular relationship of the holding assembly relative to a vertical direction.

2. The apparatus of claim 1 wherein each support mechanism is compatible with the coupling means with each support mechanism differing significantly from the others in the manner in which it may be attached to the local seating environment.

3. The apparatus of claim 1 wherein the local seating environment class includes overstuffed chairs, sofas and similar articles of furniture having padded arm rests, the selected one of the support mechanisms comprising an elongated C-shaped clamp for spanning the distance between the upper surface of an arm rest and a lower crossframe member beneath that arm rest having means for varying the clamp height to securely grip the arm rest and frame member.

4. The apparatus of claim 3 wherein the C-shaped clamp comprises a pair of telescoping tubular members each provided with a clamping leg at the end thereof remote from the telescopic junction of the tubular members, at least one of the clamping legs providing a selectable amount of angular adjustment to allow positioning the upper clamping leg in a nearly horizontal attitude despite substantial deviation of the telescoping tubular members from vertical.

5. The apparatus of claim 1 wherein the coupling means further includes an articulated horizontal arm.

6. The apparatus of claim 5 wherein the articulated arm comprises a pair of arm members journalled together at respective first ends for unrestricted angular movement in a generally horizontal plane, one of the arms having its second end pivotably attached to the selected support mechanism and the other of the arms having its second end providing pivotable support for the material holding assmebly.

7. The apparatus of claim 1 wherein the means for coupling includes a generally planar member for slidingly accepting the material holding assembly and a pivotable base member hinged together, and a varible length support leg for selectively setting the inclination of the planar member relative to the pivotable base.

8. The apparatus of claim 7 further comprising means for selectively locking the material holding assembly at a preferred elevation relative to the planar member.

9. The apparatus of claim 1 wherein several of the support mechanisms are C-clamp type mechanisms varying one from the other primarily in the local environment thickness which they are capable of spanning.

10. The apparatus of claim 1 wherein one support mechanism comprises a cross member for supporting the material holding assembly, a pair of downwardly depending upright members, and a pair of legs disposed one each at the lower ends of the upright members to provide a reading material support in the local seating environment of a bed.

11. The apparatus of claim 1 wherein at least one of the support mechanisms comprises a C-clamp type mechanism for spanning and gripping an element of the local environment, and a pivotable sleeve positionable in a generally vertical direction regardless of the orientation of the environment element gripped.

12. The apparatus of claim 11 wherein the means for coupling supports the material holding assembly for pivotable movement in a generally horizontal plane about the sleeve.

13. The apparatus of claim 1 wherein the means for coupling provides sufficient latitude in adjustability of the angular relationship of the holding assembly relative to a vertical direction that the holding assembly may be positioned in a generally horizontal attitude for use as a table.

14. Apparatus for supporting any one of a wide variety of sizes of reading materials at a freely selectable location in relation to any selected one of a wide variety of local seating environments comprising:

an expansible reading material holding assembly including lateral extension portions and telescopic risers movable in generally orthogonal directions relative to each other to expand and contract the reading material support area;

a plurality of support mechanisms each adapted for attachment to a different class of local seating environment; and means for coupling the holding assembly to a selected one of the support mechanisms including a pair of arm members journalled together at respective first ends for unrestricted angular movement in a generally horizontal plane, one of the arms having its second end pivotably attached to the selected support mechanism and the other of the arms having its second end providing pivotable support for the material holding assembly.

15. The apparatus of claim 14 wherein each support mechanism is compatible with the coupling means with each support mechanism differing significantly from the others in the manner in which it may be attached to the local seating environment.

16. The apparatus of claim 14 wherein the local seating environment class includes overstuffed chairs, sofas and similar articles of furniture having padded arm rests, the selected one of the support mechanisms comprising an elongated C-shaped clamp for spanning the distance between the upper surface of an arm rest and a lower crossframe member beneath that arm rest having means for varying the clamp height to securely grip the arm rest and frame member.

17. The apparatus of claim 16 wherein the C-shaped clamp comprises a pair of telescoping tubular members each provided with a clamping leg at the end thereof remote from the telescopic junction of the tubular members, at least one of the clamping legs providing a selectable amount of angular adjustment to allow positioning the upper clamping leg in a nearly horizontal attitude despite substantial deviation of the telescoping tubular members from vertical.

18. The apparatus of claim 14 wherein the means for coupling includes a generally planar member for slidingly accepting the material holding assembly and a pivotable base member hinged together, and a variable length support leg for selectively setting the inclination of the planar member relative to the pivotable base.

19. The apparatus of claim 14 wherein at least one of the support mechanisms comprises a C-clamp type mechanism for spanning and gripping an element of the local seating environment, and a pivotable sleeve positionable in a generally vertical direction regardless of the orientation of the environment element gripped.

20. The apparatus of claim 14 wherein the local seating environment class includes wheelchairs, tublar metal furniture and similar articles having tubular arm rests, the selected one of the support mechanisms comprising a pair of relatively flat plates for spanning a tubular arm rest having a plurality of alignable bolt receiving apertures, a sleeve therein for receiving a pin associated with the second end of the one arm of the holding assembly coupling means, and at least a pair of bolts for passing through respective alignable apertures within the pair of plates for clamping both the sleeve bearing and the tubular arm rest between the pair of plates.

21. The apparatus of claim 14 wherein the means for coupling is adapted to provide manual adjustability of the angular relationship of the holding assembly relative to a vertical direction of sufficient latitude to allow the holding assembly to be disposed in a generally horizontal attitude to function as a table.

22. Apparatus for supporting materials at a freely selectable location in relation to any selected one of a wide variety of local seating environments comprising:

a material holding assembly having a relatively flat surface and including lateral extension portions movable away from one another in the horizontal direction to expand the reading material support area and toward one another to provide a lesser width reading material support area;

a plurality of support mechanisms each adapted for attachment to a different class of local seating environment; and means for coupling the holding assembly to a selected one of the support mechanisms including a pair of arm members journaled together at respective first ends for unrestricted angular movement in a generally horizontal plane, one of the arms having its second end pivotably attached to the selected support mechanism and the other of the arms having its second end providing pivotable support for the material holding assembly;

said means for coupling is adapted to provide manual adjustability of the angular relationship of the holding assembly relative to a vertical direction of sufficient latitude to allow the holding assembly to be disposed in a generally horizontal attitude to function as a table; and wherein the material holding assembly includes a ledge along the lower edge thereof when positioned in other than a horizontal attitude for supporting reading materials and the like, and a set of telescopic risers normally disposed within the assembly and extendible to provide additional reading material support area for large reading materials.

* * * * *

UNITED STATES PATENT AND TRADEMARK OFFICE

CERTIFICATE OF CORRECTION

PATENT NO. : 4,455,008

DATED : June 19, 1984

INVENTOR(S) : James MacKew

It is certified that error appears in the above—identified patent and that said Letters Patent is hereby corrected as shown below:

Col. 1, line 55, change "te" to --the--.
Col. 3, line 10, insert --8-- after "7".
Col. 3, line 16, change "shaped" to --shaded--.
Col. 3, line 47, insert --also-- after "Fig. 5".
Col. 3, line 51, change "comprising" to --comparing--.
Col. 4, line 35, insert --a-- after "and".
Col. 6, line 9, change "assmebly" to --assembly--.
Cl. 6, Col. 7, line 19, change "assmebly" to --assembly--.
Cl. 7, Col. 7, line 23, change "varible" to --variable--.
Cl. 20, Col. 8, line 46, change "tublar" to --tubular--.

Signed and Sealed this

*Twenty-third* Day of *October 1984*

[SEAL]

*Attest:*

GERALD J. MOSSINGHOFF

*Attesting Officer*

*Commissioner of Patents and Trademarks*